US011193405B2

(12) United States Patent
Mach et al.

(10) Patent No.: US 11,193,405 B2
(45) Date of Patent: Dec. 7, 2021

(54) COMBINED EXHAUST GAS SILENCER

(71) Applicants: Zdeněk Mach, Nove Mesto nad Metuji (CZ); Zdeňka Machová, Nove Mesto nad Metuji (CZ)

(72) Inventors: Zdeněk Mach, Vsetin (CZ); Zdeněk Ekhart, Nove Mesto nad Metuji (CZ)

( * ) Notice: Subject to any disclaimer, the term of this patent is extended or adjusted under 35 U.S.C. 154(b) by 758 days.

(21) Appl. No.: 15/773,964

(22) PCT Filed: Nov. 6, 2016

(86) PCT No.: PCT/CZ2016/000120
§ 371 (c)(1),
(2) Date: Oct. 17, 2018

(87) PCT Pub. No.: WO2017/076377
PCT Pub. Date: May 11, 2017

(65) Prior Publication Data

US 2019/0032530 A1 Jan. 31, 2019

(30) Foreign Application Priority Data

Nov. 5, 2015 (CZ) ..... CZ2015-781

(51) Int. Cl.
*F01N 1/06* (2006.01)
*F01N 1/08* (2006.01)
*F01N 1/02* (2006.01)

(52) U.S. Cl.
CPC ..... *F01N 1/06* (2013.01); *F01N 1/089* (2013.01); *F01N 1/02* (2013.01); *F01N 2210/02* (2013.01);
(Continued)

(58) Field of Classification Search
CPC ... F01N 1/02; F01N 1/06; F01N 1/083; F01N 1/089; F01N 2210/02; F01N 2210/04;
(Continued)

(56) References Cited

U.S. PATENT DOCUMENTS 2,938,593 A * 5/1960 Matheny ..... B01D 45/08 181/275
4,924,966 A * 5/1990 Kanda ..... F01N 1/02 181/228

FOREIGN PATENT DOCUMENTS

EP 1541823 A2 * 6/2005 ..... F01N 1/04

OTHER PUBLICATIONS

Barron, R. F. (2003). Industrial noise control and acoustics, pp. 341-387. New York, NY: M. Dekker. (Year: 2003).*

* cited by examiner

*Primary Examiner* — Jonathan R Matthias
(74) *Attorney, Agent, or Firm* — Benesch, Friedlander, Coplan & Aronoff LLP

(57) ABSTRACT

A combined exhaust gas noise silencer consisting of a system of hollow elements with a mutual housing comprising a front face of the silencer connected to the supply pipe of exhaust gases, and a rear face of the silencer with an outlet from the rear face of the silencer, where the original—inlet exhaust gas ($\dot{I}_p$) carrying a noise wave is divided into at least two flows—an exhaust gas flow ($\dot{I}_z$) carrying a shifted noise wave with delayed wave length, and an exhaust gas flow ($\dot{I}_n$) carrying a non-shifted noise wave, which are subsequently combined into a common exhaust gas flow ($\dot{I}_s$).

10 Claims, 2 Drawing Sheets

(52) U.S. Cl.
CPC ..... *F01N 2210/04* (2013.01); *F01N 2210/06* (2013.01); *F01N 2470/20* (2013.01); *F01N 2490/04* (2013.01); *F01N 2490/10* (2013.01); *F01N 2490/20* (2013.01)

(58) Field of Classification Search
CPC ..... F01N 2210/06; F01N 2210/10; F01N 2470/20; F01N 2490/10
See application file for complete search history.

COMBINED EXHAUST GAS SILENCER

CROSS-REFERENCE TO RELATED APPLICATIONS

This application is a National stage entry under 35 U.S.C. § 371 of PCT Patent Application No. PCT/CZ2016/000120, filed Nov. 6, 2016, which claims priority to Czech Patent Application No. PV2015-781, filed on Nov. 5, 2015, each of which is hereby incorporated by reference.

FIELD OF THE INVENTION

The present technical solution relates to a combined exhaust gas silencer, especially suitable for automotive industry, forestry, agricultural and gardening equipment. The technical solution relates particularly to silencing of the exhaust gas noise by means of discharging the noise waves, in the field of road transport, shipping, railways, forestry, agricultural and gardening equipment, further in the aviation, armament industry, and the like.

STATE OF THE ART

Technical solutions related to noise silencers based on the principle of interference of exhaust gases on the absorption, resonance and adsorption-resonance basis are known. There are known technical solutions, e.g. those protected by the utility model no. 19852, in which the noise silencers comprise a cover, to which an inlet lid adapted for connection to an inlet pipe and an outlet lid adapted for connection to an outlet pipe are sealingly connected. Inside the space defined by the cover and the inlet and outlet lid, a silencing apparatus comprising an inlet chamber and an outlet chamber, which are detached by means of a partition provided with through holes, is arranged. The through holes are arranged spatially opposite each other so that the primary flow of gas entering the silencer is divided into partial flows. The primary flow of gas is loaded with the inlet pressure pulses, which are being reflected as noise. The gas pulses are of vector character. The partial flows are then loaded by vectors of the partial gas pulses. After exiting the through holes, an expansion of the partial flows of gas occurs, and the vectors of the partial pulses acquire such directions that interaction with at least some of the vectors of the pressure partial pulses from the other partial gas flows occurs. The interaction of those vectors of the pressure partial pulses, which act against each other, results in formation of reduced pressure pulses, of which the vectors are smaller than the vectors of the inlet pressure pulses. By means of this process noise is partly silenced. The main drawback of this structural arrangement is the fact that the flow of air via through holes does not occur strictly according to the theoretical assumptions. The flow depends on the size of the inlet and outlet chamber, the diameter of the through holes, and especially on the sharpness of their edges. Another drawback of this structural arrangement is the high pressure loss during the passage through the silencer, which results in reduced efficiency of the device and high technical and technological demands of such production. For example, noise waves are generated during operation of the vehicle engine, the carrier medium of which is the pulsing flow of exhaust gases. It is known that the noise intensity is reduced with the increase of losses. These losses may be increased by absorption of the noise energy, which is performed using various filling materials or resonators arranged outside the gas flow. Also perforated walls—partitions—are used for passage of a noise wave, repeated contraction and expansion, or eventually the change of direction of at least part of the main flow of exhaust gases, reflections of the noise waves, and prolongation of their pathway or cooling thereof. The resulting effect of the silencer depends also on the ratio of the silencer volume to the working volume of the engine cylinders. The construction solutions of the exhaust gas noise silencers known in the state of the art are of various combinations and mutual arrangements of the said silencing means.

For example, there is a known technical solution according to the patent no. CZ 286 939 comprising an elongated cover, the inner space of which is divided by means of alternately arranged parallel bars and partitions with spaces on their ends, or openings in their central part, into several chambers, of which the volume increases in the direction of the exhaust gas flow. Although this technical solution silences the noise waves of the exhaust gases, it is far from meeting the present requirements on the residual intensity of the noise waves.

Further a technical solution according to the patent application no. PV 1993-2264 is known, which comprises a chamber, wherein a perforated tube provided with a system of small openings and several transverse rows of larger openings passes therethrough. A reflective hollow body consisting of a pair of cones with a space between their basis is arranged in the perforated tube. At the end of the perforated tube, several rows of larger openings are provided. This solution, by means of using a through perforated tube with smaller and larger openings, through which a part of exhaust gases proceeds in two various distances into the outer part of the chamber, where they are mixed together and swirled and return back to the perforated tube, ensures higher silencing efficiency of the noise waves. However, the present requirements on the level of silencing are not met by this solution.

Another known technical solution of the silencer is described in EP 1 477 642 disclosing several variants of the silencer comprising an inlet tube extending to about ⅔ of the length from one side and an outlet tube extending to ⅔ of the length from the other side, in the elongated housing. At least one of them is provided with a set of openings. The openings are further formed in the supporting partitions of the both tubes. This solution, providing compression of the exhaust gas flow in the remaining ⅓ of the length as well as reversion of their direction and returning them into the set of openings in the supporting partitions, wherein it alters their speed and swirling. The increased intensity of the noise wave silencing in this solution is allowed by means of an inlet of a part of exhaust gases into the open space as well. Neither this solution achieves such silencing intensity of the noise waves, which is required in the present motor vehicles.

Technical solution of exhaust gas silencer according to the patent no. 196 742 is characterized in that a partition with an inclined through pipe, positioned centrally or eccentrically, is arranged in the chamber between two Helmholz resonators, in order to direct the flow and noise waves against the cylindrical wall of the silencer housing. The main drawback of this structural arrangement lies in low silencing efficiency.

There is another known technical solution titled, Modular catalytic converter and muffler for internal combustion engine "according to U.S. Pat. No. 5,578,277, where a catalyser and a silencer are merged into one unit. An exhaust gas flow is directed through the expansion chamber to seven partial catalysers, integrated in the chamber partition. The partial catalysers are tubes terminated with permeable, catalytically active, ceramic wall. The exhaust gas flow and the noise wave from catalysers are further directed against two consecutively arranged concave partitions with a plurality of openings, and subsequently through the pipe into a free atmosphere. The main drawback of this structural arrangement lies in low efficiency of noise silencing.

There is also known technical solution described in PV 1999-2583, where the exhaust gas flow is directed against a centrally arranged convex shield with a diameter smaller than the diameter of the cylindrical expansion chamber, and through the formed annular opening further against the convex wall connected impermeable around its circumference with the chamber housing. Openings of various shapes are defined in the second concave wall. The exhaust gas flow and the noise wave are directed through them into the chamber terminated in the flow direction with a partition, in which the entrances to the pipes of the resonator—pipes of various lengths open on both ends, leading into another chamber. The exhaust gas flow and the noise wave are lead along two routes, the openings in the housing of the axially and tangentially located tube and the openings defined on the surface of the cylindrical chamber, further to a common outlet into free atmosphere. This silencer did not show sufficient results, as the whistle silencer itself does not show a silencing effect, rather the opposite. In any case, it alters the phase of the noise wave, and its energy may be reduced by interference with the noise wave of the original phase. The silencer according to the mentioned patent application lacks this feature.

Another technical solution of the noise silencer according to the patent CZ 297930 B6 comprises an inlet and a cylindrical cover provided with an outlet pipe on the opposite end. It is characterized in that the cylindrical cover is on its inside divided into at least four working sections comprising axially arranged silencing elements, expansion chamber, whirling chamber, a pair of pipe resonator systems, and whirling, directing and accumulative elements, defined by at least three transversely arranged partitions, wherein towards the opposite outlet pipe the cylindrical cover is provided with an inlet section, freely encompassing its first working section provided with exhaust gas inlet openings, wherein the inlet section is fixed to the surface of the cylindrical cover.

Drawbacks of this solution (completely different from the present invention) lie in the fact that the exhaust gas flow carrying a noise wave cannot achieve a $\lambda/2$ shift of its noise wave, as both flows are mixed together in the mixing space of the second working section after passing the first resonator, and thanks to this no $\lambda/2$ shift of the noise wave occurs after passing the second resonator, only a $\lambda/4$ shift, and the wave length is shifted (delayed) by $\pi/2$. The effects of both resonators are not accumulated and no mirror effect occurs in the mixing chamber. The original and the delayed phase do not go against each other with a delay of the whole $\pi$ and with the $\lambda/2$ shift.

Because no mirror effect occurs and thus no discharging of the noise wave, but its interference, the value of the noise silencing, back pressure, PHM consumption, the emission value and the exhaust gas temperature do not achieve the required and expected result in the end.

The main drawback of the above mentioned structural arrangements lies especially in the fact that longitudinal oscillation occurs in the noise waves, thus densification and rarefication of the carrier atmosphere—medium. The noise intensity corresponds to the level of noise energy, which passes an area of 1 $cm^2$ per a time unit arranged perpendicular to the flow direction. Such defined noise intensity depends on the squared amplitude and squared frequencies of the complex of partial noise waves, on the density of the carrier atmosphere (medium) and on the noise speed therein, i.e. also on its temperature, the noise is thus reduced with the decreasing temperature. The carrier atmosphere of the exhaust gases from combustion engines is a pulsing flow of exhaust gases directed through the pipe from the engine into free atmosphere. The number of pulses is determined by the engine speed. The noise intensity is reduced with increase of losses. These losses may be increased by means of absorption of noise energy. Various materials for filling the silencers are used, e.g. glass, asbestos or steel wool, or resonators arranged outside the flow (Helmholz-type resonators). Among other known means reducing the noise intensity belongs:

passage of the noise wave through perforated walls—partitions (repeated contractions and expansion resulting in reduction of noise energy), further division of the exhaust gas flow into several partial flows, in which the phases of the partial noise waves are altered and these are subsequently directed to the mixing chamber, where their mutual interaction occurs, resulting in silencing. The change of partial noise wave phases is achieved by means of their reflection or reversion of the direction of their movement, change of their pathway length or speed, or eventually by means of reducing the temperature of partial noise waves of the carrier medium. A method of phase delay of the noise waves by means of their passage through pipe (whistle) resonators is known. Interaction of the partial noise waves promotes turbulence of the carrying gas medium. The resulting effect of each silencer depends on dimensions of the particular silencer elements, on their mutual arrangement as well as on the ratio of the silencer volume to the working volume of the engine cylinders. Current solutions of the exhaust gas silencers in the automobiles in various structural embodiments use various combinations and various mutual arrangements of the named silencing means.

The document DE 727961 C discloses an exhaust gas silencer, in which the noise (wave) is divided simultaneously into several, at least two paths, where the same flow resistance is obtained in all paths provided that the tubes with different length and diameter have the same flow resistance and each resonator that follows the previous one has the same marginal frequency, while the content of chambers and the conductivity of tubes can differ. The document does not directly describe the delay of the flow or shifts of the wave, it is more focussed on conditions to be met than on constructional arrangements, which can be indirectly derived mainly from figures indicating that the silencer consists of hollow elements with a mutual housing, comprising a front face connected to an exhaust gas supply pipe, a rear face with outlet from the rear face and chambers divided by transverse partitions, where an inlet chamber is located between the front face and the inlet transverse partition and a common outlet chamber is located between outlet transverse partition, where adjacent chambers are interconnected by pipes and at least one pair of distant chambers are also interconnected by pipe. Pipes have variable lengths and diameters and their inlets and outlets are located out of the transverse partitions plane. Between the inlet transverse partition and the outlet transverse partition there is one chamber (FIG. 3 of the document) or alternatively more subsequently located chambers (FIGS. 1 and 2 of the document) in the direction of the flow which are mutually divided by others middle transverse partitions.

SUMMARY OF THE INVENTION

The mentioned drawbacks are substantially eliminated by means of a combined exhaust gas noise silencer consisting of a system of hollow elements with a mutual housing comprising a front face of the silencer connected to the supply pipe of exhaust gases, and a rear face of the silencer with an outlet from the rear face of the silencer, where the original—inlet exhaust gas ($\dot{I}_n$) carrying a noise wave is divided into at least two flows—an exhaust gas flow ($\dot{I}_z$) carrying a shifted noise wave with delayed wave length, and an exhaust gas flow ($\dot{I}_n$) carrying a non-shifted noise wave, which are subsequently combined into a common exhaust gas flow ($\dot{I}_s$) according to the present invention, characterized in that the system of hollow elements consists of an inlet expansion chamber connected to the front face of the silencer and the common outlet expansion and mixing chamber with inlet openings of the common outlet expansion and mixing chamber connected to the rear face of the silencer, between which one or more inner expansion chambers of the non-delayed flow, arranged in the direction of the noise wave passage, having inlet openings of the inner chamber in the transverse partitions on their inlet and in parallel to them 4n+2, where n is 0 or positive integer number; inner expansion chambers of the delayed flow arranged sequentially in the direction of the noise wave passage, with inlet openings of the inner chambers in the transverse partitions on their inlet, where each of the inner expansion chamber of the delayed flow comprises a resonator tube, provided that the ratio of the length of each resonator to the length of a corresponding inner expansion chamber of the delayed flow lies in the interval of 0.3 to 0.8, and the ratio of the cross-section surface of each resonator to the cross-section surface of the inner exhaust gas supply pipe lies in the interval of 0.3 to 0.8, and the surface size of the inlet openings of inner chambers in the transverse partitions is the same ±10% as the surface size of the cross-section of the resonator tube, and wherein the sum of the length of all sequentially arranged inner expansion chambers of the non-delayed exhaust gas flow is the same ±10% as the sum of all length of all sequentially arranged inner expansion chamber of delayed flows.

The solution according to the present invention eliminated the drawbacks and disadvantages described in the state of the art using a "combined exhaust gas noise silencer" in that it maximally eliminates the noise intensity of exhaust gases to minimum, wherein by using the resonators—open at both ends and rounded at their outlet tubes with their own noise waves interference ability—one or more of the noise waves, or eventually the whole noise spectrum, is discharged. Maximum efficiency of this phenomenon ant its result is achieved provided that the wave length of the noise wave is delayed by π/2 value during its passage through the tube resonator, while the noise wave is shifted by ¼ of their wave length.

For achieving the above mentioned delay or shift respectively, it is necessary to maintain certain requirements in production of the combined exhaust gas noise silencer. In a preferred embodiment, each of the inner expansion chambers of the delayed flow is provided with the same resonator tube, provided that the ratio of the length of each resonator tube to the length of the corresponding inner expansion chamber of the delayed flow is 0.5±0.1, preferably 0.5.

It is also advantageous if the ratio of the intersection surface of each resonator tube to the cross-section surface of the inlet exhaust gas supply pipe is 0.5±0.1, preferably 0.5.

It is further advantageous if the surface size of the inlet openings of inner chambers in the transverse partitions is the same ±1% as the cross-section surface size of the resonator tube.

Preferably, the sum of the lengths of all sequentially arranged inner expansion chambers of non-delayed exhaust gas flow is the same ±1% as the sum of the lengths of all sequentially arranged inner expansion chambers of the delayed flows.

In terms of minimum spatial and construction requirements for the exhaust gas noise silencer, it is preferable if the number of the sequentially arranged inner expansion chambers of the delayed flow is two and/or the number of the inner expansion chambers of the non-delayed flow is exactly one. In the most preferred embodiment, the ratio of the length of the tube of each resonators to the length of the expansion chamber of the delayed flow is exactly 0.5, the ratio of the cross-section surface of each resonator tube to the cross-section surface of the inlet exhaust gas supply pipe is exactly 0.5, the surface size of the inlet openings of inner chambers in the transverse partitions is the same as the surface size of the cross-section surface of the resonator tube, and the sum of all lengths of all sequentially arranged inner expansion chambers of non-delayed exhaust gas flow is the same as the sum of the length of all sequentially arranged inner expansion chambers of the delayed flows. In that case, the wavelength of the noise wave is delayed altogether by a whole π during passage of the delayed exhaust gas flow ($\dot{I}_z$) through the inner expansion chamber of the delayed flow with determined parameters, and the noise wave is shifted by exactly ½ of its wave length λ, by means of which a harmonious accumulation occurs in the unified current ($\dot{I}_s$) and an entirely new mirror wave is formed, and the wavelengths or eventually the whole noise spectrum is discharged.

The main noise wave settles in the resonator tube axis as a quasi-half-wave and the rounding of the resonator tube allows settling of the related noise waves around. This phenomenon is achieved by the present solution so that it divides the original exhaust gas flow into at least two branches, wherein the non-delayed exhaust gas flow ($\dot{I}_p$) with the non-shifted noise wave passes through one of them, and in the second branch the flow ($\dot{I}_z$) carrying a noise wave is double delayed by ¼ of its wavelength λ, thus altogether by ½ of its wave length. The basic scheme of the invention is illustrated in the FIG. 1 and FIG. 2.

The present invention is, among applying the already known silencing principles (contraction and expansion, increasing and reducing the gas pressure, division and subsequent mixing of the flows), is characterized by the overall delay of the noise wave by a π value, and shifting of the noise wave only by ½ of their noise wave λ, caused by inserting two, six, ten, etc. identical systems of tube resonators into at least one of the exhaust gas flows, wherein the exhaust gas flow exiting the resonators is separated from the other flows by means of a full, elongated partition, arranged in parallel to the axis of the silencer, and subsequently directed together with at least one other exhaust gas flow into a common mixing and expansion chamber, in which the noise waves carried by both exhaust gas flows form a unified flow, in which they interfere with each other, including forming of a mirror wave and subsequent discharging of the noise wave or eventually of the whole noise spectrum.

The main part of the silencing process is represented by discharging the noise waves delayed by π/2 and mutually shifted by ¼ of the wave length.

In the noise wave of the particular phase is the wave length delayed by π/2 during passage through the resonator tube, therefore the noise wave is shifted only by ¼ of its wave length λ. While passing the tube of the second, tandem-arranged, identical resonator, the process is repeated provided that the wave length is altogether delayed by a whole π, but the noise wave is shifted only by ½ of its noise wave λ. A mirror wave is formed and discharging occurs.

Rounding (concave or convex) of the free end of the resonator tube is in comparison to tapering—angled shearing—more advantageous in that an increase of the circumferential dimensions occurs while preserving the same surface and diameter, and a higher number of referential waves is settled therein, while preserving the same settled maximum and minimum of noise waves in the tube axis.

Another variant of the resonator tube embodiment is a rectangular cross-section of the cascade embodiment, thus with the change of cross-section performed sequentially and in steps, or a triangular or trapezoidal cross-section for collecting a higher number and ranges of wave lengths, where the minimum dimension of one side must be the same or larger than 0.3 mm (and ≥0.3 mm), as the size of 0.2 mm or less causes high frequency whistling.

Noise wave silencing according to the present invention is not dependent on the engine volume size (by, not discharging "the noise wave, the back pressure increases and the engine volume must be adapted for this), but it is determined by the cross-section of the exhaust gas pipe—system—of the exhaust gases from the engine, which allows reduction of the overall dimensions of the silencer system and subsequent reduction of its weight.

Low resistance of the passage of the exhaust gases through the silencer and efficient interference together with discharging of the noise waves allows to achieve less noise on their silencer outlet while using less back pressure in comparison to other solutions, which results also in considerable fuel saving and reduced $CO_2$ emissions, which influences the amount of produced CO as well as the temperature of exhaust gases, by discharging the material noise wave using interference, which causes substantial decrease of pressure (and subsequently water) in the silencer, which further results in nearly no corrosion of the silencer material, increasing its service life.

For correct operation of the combined exhaust noise silencer, the inner continuous expansion chamber of the non-delayed exhaust gas flow ($\dot{I}_n$) and at least one inner expansion chamber of the non-delayed exhaust gas flow ($\dot{I}_z$) are preferably separated by means of at least one partition, in parallel with the silencer axis, separating the non-delayed and delayed exhaust gas flows after passing the inlet expansion chamber before their entrance to the common outlet expansion and mixing chamber, and at least one another inner expansion chamber of the delayed exhaust gas flow ($\dot{I}_z$) with the second resonator is connected to the first inner expansion chamber of the delayed exhaust gas flow ($\dot{I}_z$), and the inner expansion chambers of the delayed exhaust gas flow ($\dot{I}_z$) are arranged sequentially after each other and provided with a tandem of identical tube resonators connected to each other without any other inserted elements, and the ratio of the tube length of each resonator to the length of the corresponding inner expansion chamber of the delayed exhaust gas flow ($\dot{I}_z$) is 0.5, and the ratio of the cross-section surface of the tube of each resonator to the cross-section of the inlet exhaust gas supply pipe is 0.5, the cross-section of the resonator tube, especially the inner one, has a shape of trapezoid, triangle, square, rhombus, parallelogram polygon or a cascade shape, the end of the resonator tube has a rounded shape, concave or convex, which increases the efficiency with respect to the amount of discharged waves.

In a preferred embodiment, the output of the rear face of the combined exhaust gas noise silencer is a perforated partition or an ordinary piping.

The invention aims at decreasing the undesirable effects, namely the noise higher than 50 dB (causing stress and mental depression), reducing PHM consumption, and subsequent reducing of $CO/CO_2$ emissions, as well as at reducing vibrations and shaking, including the reduction of the exhaust gas temperature.

The invention fills the gap in facilities in the known scope and noise silencing efficiency.

BRIEF DESCRIPTION OF DRAWINGS

The invention will be further described using figures, in which the FIG. 1 illustrates a combined noise silencer, and the FIG. 2 illustrates a combined noise silencer with the indicated exhaust gas flows ($\dot{I}_n$ $\dot{I}_z$, $\dot{I}_p$, $\dot{I}_v$)

DETAILED DESCRIPTION OF PREFERRED EMBODIMENTS

Figure 1:
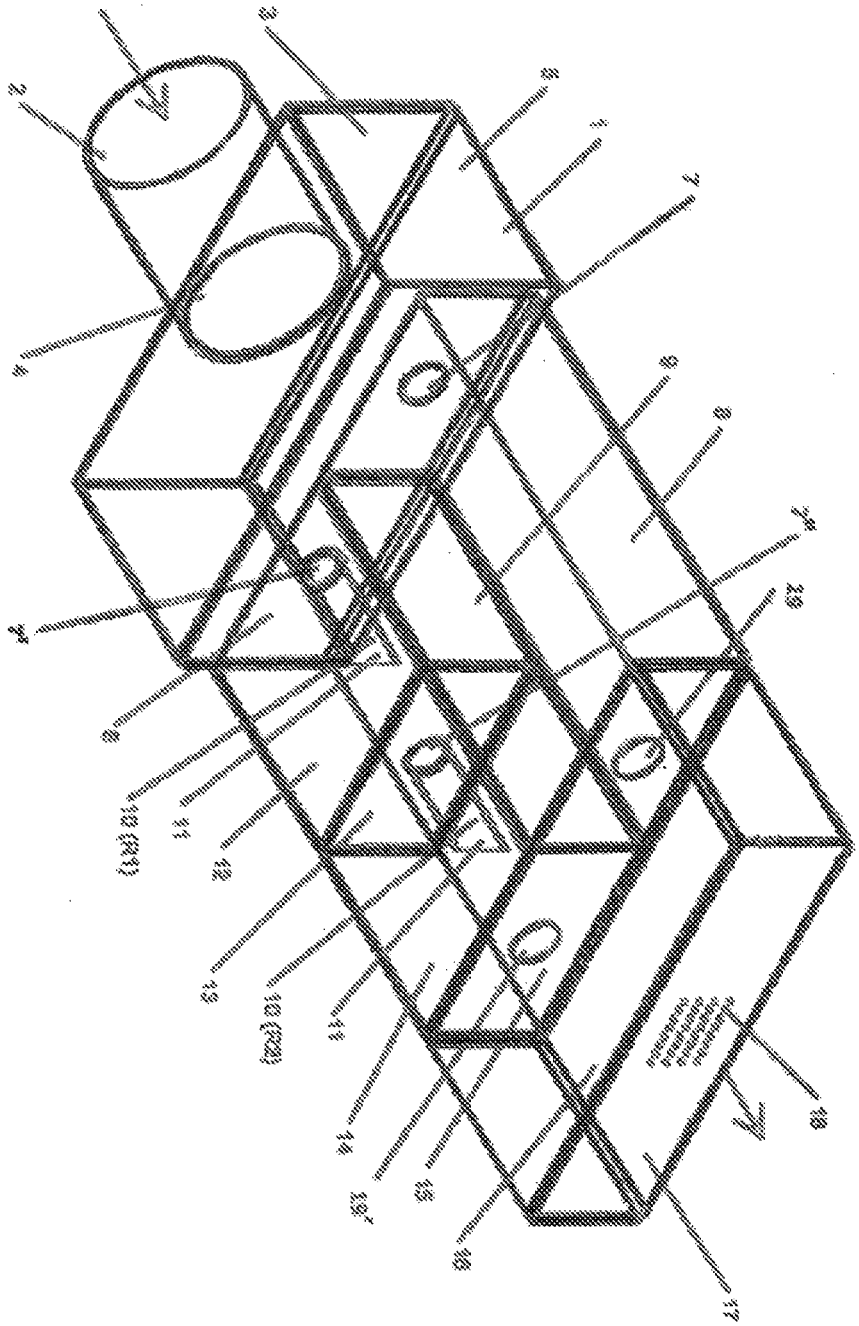
Figure 2:
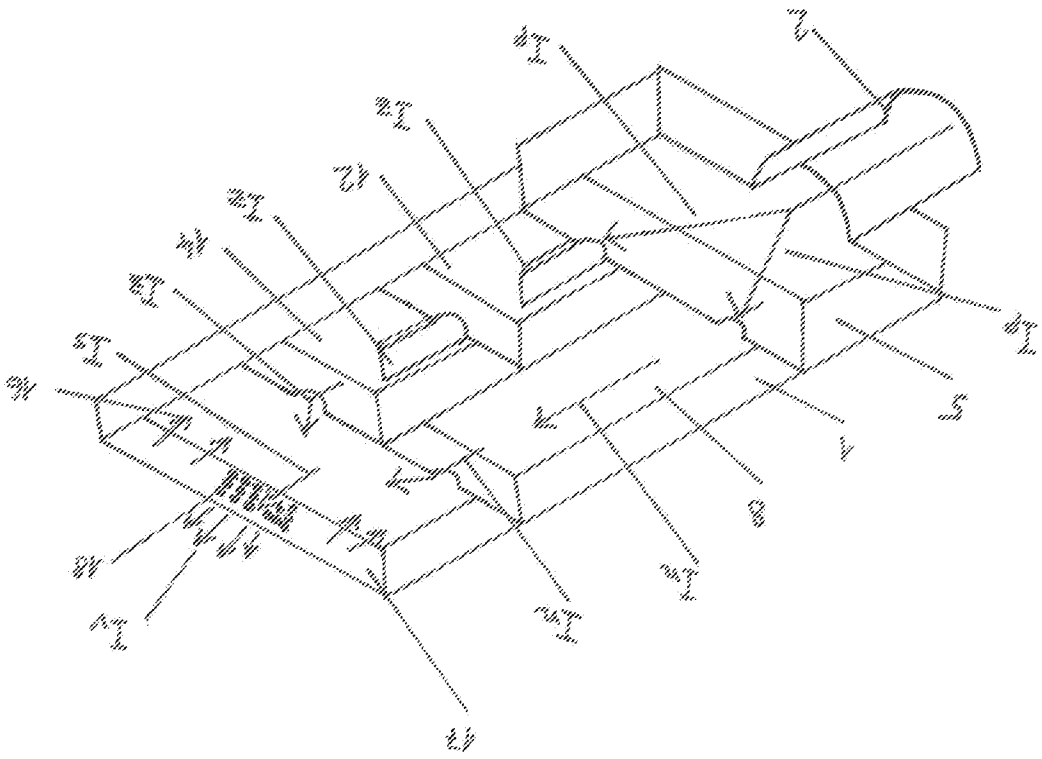

A combined exhaust gas noise silencer according to the FIGS. 1 and 2 consists of a system of hollow elements with a mutual housing 1 connected with an exhaust gas supply pipe 2 on one side and with an outlet part of the exhaust apparatus on the other side. The original inlet exhaust gas flow ($\dot{I}_p$) carrying a noise wave is divided into at least two flows—a delayed exhaust gas flow ($\dot{I}_z$) carrying a shifted noise wave with delayed wave length and non-delayed exhaust gas flow ($\dot{I}_n$) carrying a non-shifted noise wave with a non-delayed wave length. The exhaust gas flows are subsequently combined into a common exhaust gas flow ($\dot{I}_s$) carrying a noise wave with a phase shift, from which a resulting exhaust gas flow ($\dot{I}_v$) is formed after discharging the noise wave on the outlet. The system of hollow elements with the common housing 1 comprises on its inlet an inlet expansion chamber 5 and on the outlet an outlet expansion and mixing chamber 16. Between the inlet expansion chamber 5 and the common outlet expansion and mixing chamber 16, inner expansion chambers are arranged. The exemplary embodiment features one inner expansion chamber 8 of the non-delayed exhaust gas flow ($\dot{I}_n$) and preferably two inner expansion chambers: the first inner expansion chamber 12 of the delayed exhaust gas flow ($\dot{I}_z$) with the first resonator 10(R1) and the second inner expansion chamber 14 of the delayed exhaust gas flow ($\dot{I}_z$) with the second resonator 10(R2). Ratio of the length of each resonator tube 11 to the length of a corresponding inner expansion chamber 12, 14 of the delayed exhaust gas flow ($\dot{I}_z$) is preferably, and in this exemplary embodiment, 0.5. Ratio of the cross-section surface of the tube 11 of the first resonator 10(R1) to the cross-section surface of the inlet exhaust gas supply pipe 2 is preferably, and in this exemplary embodiment, 0.5. Ratio of the cross-section surface of the tube 11 of the second resonator 10(R2) to the cross-section surface of the inlet exhaust gas supply pipe 2 is preferably, and in this exemplary embodiment, 0.5. Ratio of the surface of the inner chamber inlet openings 7 in the partitions on the inlet and on the outlet of the inner expansion chamber 8 of the non-delayed flow (and on the outlet of the second inner expansion chamber 14 of the delayed flow to the cross-section surface of the inlet exhaust gas supply pipe 2) is preferably, and in this exemplary embodiment, 0.5. During passage of the delayed exhaust gas flow ($\dot{I}_z$) through the inner expansion chambers 12, 14 with the mentioned parameters, the wave length of the noise wave is in this case delayed by a whole π and the noise wave is shifted by ½ of its wave length λ, by means of which a mirror wave is formed in the combined exhaust gas flow ($\dot{I}_s$), and discharging of the noise waves or eventually of the whole noise spectrum occurs. In this exemplary embodiment, one inner expansion chamber 8 of the non-delayed exhaust gas flow ($\dot{I}_n$) is separated from the inner expansion chambers 12, 14 of the delayed exhaust gas flow ($\dot{I}_z$) by means of at least one elongated partition 9, longitudinal with the silencer axis, separating the non-delayed and the delayed exhaust gas flow after passing the inner expansion chamber 5, before entering the common outlet expansion and mixing chamber 16. The first inner expansion chamber 12 of the delayed exhaust gas flow ($\dot{I}_z$) with the first resonator 10(R1) continues with the second expansion chamber 14 of the delayed exhaust gas flow ($\dot{I}_z$) with the second resonator 10(R2). The inner expansion chambers 12, 14 of the delayed exhaust gas flow ($\dot{I}_z$) are arranged sequentially one after another without any other inserted elements, provided that the ratio of the length of each resonator tube 11 to the length of the corresponding inner expansion chamber 12, 14 of the delayed exhaust gas flow ($\dot{I}_z$) is preferably, and in this exemplary embodiment, 0.5, and the ratio of the cross-section surface of each resonator tube 11 to the cross-section surface of the inlet exhaust gas supply pipe 2 is preferably, and in this exemplary embodiment 0.5. The inner cross-section of the resonator tube 11 has preferably shape of a circle, rectangle, trapezoid, triangle, square, rhombus, parallelogram polygon or a cascade shape. In the preferred embodiment, the end of the resonator tube 11 has a rounded shape, convex or concave.

A combined noise silencer according to the present invention, according to the exemplary embodiment, consists of a common housing 1 of the system of hollow elements consisting of resonator and interference chambers, into which the inlet exhaust gas supply pipe 2 exits at the rear face 3 of the silencer via the opening 4 in the rear face of the silencer.

All parts of the silencer are rigid and immobile. All transverse, construction partitions 6, 13, 15 in the silencer system are, thanks to the inlet openings 7 of the inner chambers or the inlet openings 19 common with the outlet expansion and mixing chamber, permeable for the exhaust gas flows carrying a noise wave.

Tandem (sequential) tube resonators, i.e. the first resonator 10(R1) and the second resonator 10(R2), are connected together without any other inserted elements—members.

The first sub-system consists of the inlet expansion chamber 5, which is in this exemplary embodiment separated by means of a transverse 6 partition from the flow sub-system of the second branch carrying a shifted noise wave, consisting of the first inner expansion chamber 12 of the delayed flow with the first resonator 10(R1) and the second inner expansion chamber 14 of the delayed flow with the second resonator 10(R2), and at the same time it is separated by means of the transverse partition 6 from the flow sub-system of the left chamber carrying a non-shifted noise wave consisting of the inner expansion chamber 8 of the non-delayed flow.

The inner expansion chamber 5 is separated from the first inner expansion chamber 12 of the delayed flow with the first resonator by means of the transverse partition 6 with the opening 7 of the inner chamber, for the inlet into the tube 11 of the first resonator 10(R1), and from the inner expansion chamber 8 of the non-delayed flow by means of the transverse partition 6 with the inner opening 7 of the expansion chamber. The first inner expansion chamber 12 of the delayed flow with the first resonator is connected, by means of the transverse partition 13 with the inlet opening 7 of the inner chamber for an inlet into the tube 11 of the second resonator, with the second inner expansion chamber 14 of the delayed flow with the second resonator, wherein a common outlet expansion and mixing chamber 16 is connected therein by means of a transverse partition 15 with the inlet opening 19 of the common outlet and mixing chamber.

In this exemplary embodiment, in the left branch of the flow, a common outlet expansion and mixing chamber 16 is connected to the inner expansion chamber 8 of the non-delayed flow via a transverse partition 15 with the inlet opening 19 of the common outlet expansion and mixing chamber.

The first inner expansion chamber 12 of the delayed flow with the first resonator and the second inner expansion chamber 14 of the delayed flow with the second resonator are separated from the inner expansion chamber 8 of the non-delayed flow by means of an elongated partition 9.

A common outlet expansion and mixing chamber 16 in this exemplary embodiment is terminated with a perforated rear face 17 of the silencer with the openings on the outlet 18 from the rear face of the silencer into atmosphere. In another exemplary embodiment, an ordinary outlet piping exiting into atmosphere is arranged on the outlet instead of the perforated openings.

In a not illustrated case, the inner expansion chamber 8 of the non-delayed flow may be provided with another transverse partition 13 with the inlet opening 7 of the inner chamber.

In another exemplary embodiment, the whole system of inner chambers may be arranged so that the left and right sides are interchanged, or eventually the arrangement may be carried out using a "tube in a tube" method, i.e. using one chamber, for example the chamber with delayed flow may be surrounded by the second chamber with the non-delayed flow, and the other way around.

In another exemplary embodiment, the exhaust gas supply pipe 2 may be oriented towards the inlet expansion chamber 5 on the side of this chamber, as well as the openings 18 or the outlet pipe from the common outlet expansion and mixing chamber 16 on the side of this chamber.

The combined exhaust gas noise silencer is arranged in the axis of the exhaust gas supply pipe 2 on the side of the engine. Exhaust gases are supplied by means of the exhaust gas supply pipe 2 into the said noise silencer through the front face 3 of the silencer and through the opening 4 in the front face of the silencer. Exhaust gases are also the carrying medium of the noise wave, and thus the noise wave is affected in the similar manner as well. Exhaust gas flow enters the inlet expansion chamber 5 through the opening 4 in the front face of the silencer, where it is in this particular case divided into two branches, the right and the left branch. It enters the left branch through the inlet inner chamber opening 7 in the transverse partition 6, which at the same time separates the inlet expansion chamber 5 from the first inner expansion chamber 12 of the delayed flow with the first resonator.

The exhaust gas flow carrying a noise wave enters the right branch through the inlet inner chamber opening 7 for the tube 11 of the first resonator 10(R1) formed in the transverse partition 6. While the noise wave remains non-shifted in the left branch of the inner expansion chamber 8 of the non-delayed flow, the main noise wave in the right branch of the first inner expansion chamber 12 of the delayed flor with the first resonator, upon passage through the tube 11 of the first resonator 10(R1), settles in the axis of the resonator tube 11 as a quasi-half-wave, and its related waves are settled around, and the wave length in this case is delayed by $\pi/2$ and thus the noise wave is shifted by ¼ of its wave length. After exiting the first inner expansion chamber 12 of delayed flow with the first resonator, the exhaust gas flows carrying a noise wave are moved to the second inner expansion chamber 14 of the delayed flow with the second resonator through the opening in the transverse partition 13 with the inlet opening 7 for the tube 11 of the second resonator. While the noise wave remains non-delayed in the left branch after passing the inner expansion chamber 8 of the non-delayed flow, the main noise wave in the right branch of the second inner expansion chamber 14 of the delayed flow with the second resonator, after passing the tube 11 of the second resonator 10(R2), is settled in the axis of the resonator tube 11 as a quasi-half-wave, and its related waves are settled around, and the wave length in this case is delayed by $\pi/2$ and thus the noise wave is shifted only by ¼ of its wave length $\lambda$. In this case, the tubes 11 of the resonators 10(R1) and 10(R2) create the overall delay effect of the wave length by a whole $\pi$ and the shift of the noise wave by ½ of its wave length $\lambda$. This is a positive shift—a real mirror wave is formed.

The left branch carrying a non-shifted noise wave as well as the right branch carrying a noise wave shifted by ½ of its wave length flow through the inlet openings 19 of the common expansion and mixing chamber in the transverse partition 15 with the openings into the common outlet expansion and mixing chamber 16 at the same time. Upon the impact on the rear face 17 of the silencer, the noise wave is automatically changed into the opposite phase, which is the most important for the function of the noise wave. The noise waves in this chamber interfere and their discharging occurs.

In one exemplary embodiment, the common outlet expansion and mixing chamber 16 is terminated with the perforated rear face 17 of the silencer, with the openings on the outlet 18 of the rear face of the silencer into the atmosphere. The function of this common outlet expansion and mixing chamber 16 with the rear face 17 of the silencer differs from the other embodiments in that the noise wave shifted by ½ of its wave length meets with the phase opposite to the original wave. In this exemplary embodiment, the perforated openings on the outlet 18 of the rear face of the silencer silence the high-frequency noise components.

Within the examination, the tests with the following results were performed:

a) influence of the ratio of the resonator length $l_1$ to the inner expansion chamber length $l_2$ on the value of the exhaust gas noise silencing, in the embodiment according to the FIG. 1 (with $S_1/S_2$=0.5 and the initial exhaust gas noise level of 79.2 dB)

| s.n. | $l_1/l_2$ | silencing/dB |
|---|---|---|
| 1 | 0.1 | 0.3 |
| 2 | 0.2 | 0.8 |
| 3 | 0.3 | 1.7 |
| 4 | 0.4 | 2.9 |
| 5 | 0.5 | 4.9 |
| 6 | 0.6 | 4.1 |
| 7 | 0.7 | 3.8 |
| 8 | 0.8 | 2.6 |
| 9 | 0.9 | 1.1 |

b) influence of the ratio of the resonator cross-section $S_1$ (surface) to the cross-section $S_2$ (surface) of the exhaust gas supply pipe on the noise silencing value, in the embodiment of the noise silencer according to the FIG. 1 (with $l_1/l_2$=0.5 and the initial exhaust gas noise level of 79.2 dB)

| s.n. | $S_1/S_2$ | silencing/dB |
|---|---|---|
| 1 | 0.1 | 0.6 |
| 2 | 0.2 | 1.2 |
| 3 | 0.3 | 1.7 |
| 4 | 0.4 | 3.6 |
| 5 | 0.5 | 4.9 |
| 6 | 0.6 | 4.0 |
| 7 | 0.7 | 3.2 |
| 8 | 0.8 | 2.4 |
| 9 | 0.9 | 1.8 |
| 10 | 1.0 | 1.2 |
| 11 | 1.1 | 1.0 |
| 12 | 1.2 | 0.7 |

c) influence of the combination of ratios of the resonator length $l_1$ to the length $l_2$ of the inner expansion chamber and the ratio of the resonator cross-section (surface) $S_1$ to the cross-section (surface) $S_2$ of the exhaust gas supply pipe on the value of the noise silencing in the noise silencer embodiment according to the FIG. 1

| s.n. | $l_1/l_2$ | $S_1/S_2$ | silencing/dB |
|---|---|---|---|
| 1 | 0.1 | 1.0 | 0.3 |
| 2 | 0.9 | 0.1 | 0.3 |
| 3 | 0.9 | 1.2 | 0.4 |
| 4 | 0.3 | 0.3 | 0.8 |
| 5 | 0.3 | 0.4 | 1.1 |
| 6 | 0.3 | 0.5 | 1.7 |
| 7 | 0.3 | 0.6 | 1.8 |
| 8 | 0.3 | 0.7 | 2.0 |
| 9 | 0.4 | 0.3 | 0.8 |
| 10 | 0.4 | 0.4 | 2.6 |
| 11 | 0.4 | 0.5 | 2.9 |
| 12 | 0.4 | 0.6 | 2.6 |
| 13 | 0.4 | 0.7 | 2.2 |
| 14 | 0.5 | 0.4 | 3.6 |
| 15 | 0.5 | 0.5 | 4.9 |
| 16 | 0.5 | 0.6 | 4.0 |
| 17 | 0.5 | 0.7 | 3.2 |
| 18 | 0.6 | 0.4 | 3.5 |
| 19 | 0.6 | 0.5 | 4.1 |
| 20 | 0.6 | 0.6 | 3.8 |
| 21 | 0.6 | 0.7 | 3.4 |
| 22 | 0.7 | 0.4 | 1.9 |
| 23 | 0.7 | 0.5 | 3.8 |
| 24 | 0.7 | 0.6 | 3.9 |
| 25 | 0.7 | 0.7 | 4.0 |
| 26 | 0.7 | 0.8 | 3.9 |
| 27 | 0.7 | 0.9 | 2.8 |
| 28 | 0.8 | 0.5 | 2.6 |
| 29 | 0.8 | 0.6 | 2.8 |
| 30 | 0.8 | 0.7 | 2.9 |
| 31 | 0.8 | 0.8 | 3.2 |
| 32 | 0.8 | 0.9 | 3.0 |
| 33 | 0.1 | 0.1 | 0.4 |
| 34 | 0.1 | 0.7 | 0.6 |
| 35 | 0.1 | 0.9 | 0.3 |

Note: Noise level measurements were performed using a motor mower HECHT IP64FA with a combined exhaust gas noise silencer according to the FIG. 1 in the distance of 3 m from the source of noise (measurement was performed according to known recommendations for measurement of combustion engine noise). The given values are the statistical mean of 20 measurements.

The measured values and measurement results prove the optimum ratio of the lengths of the resonator tubes 11 to the length of the inner expansion chamber as well as the optimum ratio of the cross-section (surface) of the resonator tube 11 to the surface of the exhaust gas supply pipe 2.

INDUSTRIAL APPLICABILITY

The invention relates to a combined silencer of the exhaust gas noise, namely intended for automotive industry, forestry, agricultural and gardening equipment, but also applicable in the other fields of road transport, shipping and railway transport, forestry, agricultural and gardening equipment, further also in aviation and armament industry, and the like.

A combined silencer of the exhaust gas noise of the present invention may be preferably used in combustion engines, especially motor vehicles, and gardening equipment with a requirement for a high level of noise silencing.

LIST OF REFERENCE SIGNS AND THEIR DESCRIPTION

| Reference sign | FIG. 1, FIG. 2 |
|---|---|
| 1 | Mutual housing |
| 2 | Exhaust gas supply pipe |
| 3 | Front face of the silencer |
| 4 | Opening in the front face of the silencer |
| 5 | Inlet expansion chamber |
| 6 | Inlet transverse partition |
| 7 | Inlet opening of the inner chamber |
| 8 | Inner expansion chamber of the non-delayed flow |
| 9 | Elongated partition |
| 10(R1) | First resonator |
| 10(R2) | Second resonator |
| 11 | Resonator tube |
| 12 | First inner expansion chamber of the delayed flow |
| 13 | Transverse partition with an opening for the second resonator pipe |
| 14 | Second inner expansion chamber of the delayed flow |
| 15 | Outlet transverse partition |
| 16 | Common outlet expansion and mixing chamber |
| 17 | Rear face of the silencer |
| 18 | Outlet of the rear face of the silencer |
| 19 | Inlet opening of the common outlet expansion and mixing chamber |

Legend—Description and Clarification of the Exhaust Gas Flows

| Reference sign | Description |
|---|---|
| $i_p$ | Original inlet exhaust gas flow carrying a noise wave |
| $i_z$ | Exhaust gas flow carrying a shifted noise wave |
| $i_n$ | Exhaust gas flow carrying a non-shifted noise wave |
| $i_s$ | Unified exhaust gas flow carrying a noise wave with a phase shift |
| $i_v$ | Resulting exhaust gas flow after discharging the noise wave |

The invention claimed is:

1. A combined exhaust gas noise silencer consisting of a system of hollow elements within a mutual housing (1) comprising:

a front face (3) and a rear face (17);

an exhaust gas supply pipe (2) connected to the front face (3), and an outlet (18) on the rear face (17);

the system of hollow elements are divided by transverse partitions disposed between the front face (3) and the rear face (17);

wherein an inlet gas flow ($\dot{I}_p$) carrying a noise wave is divided into two flow paths: a shifted noise wave flow path ($\dot{I}_z$) with a delayed wave length and a non-shifted noise wave flow path ($\dot{I}_n$) with a non-delayed wave length, wherein both the shifted noise wave flow path ($\dot{I}_z$) and the non-shifted noise wave flow path ($\dot{I}_n$) are subsequently combined into a common flow path ($\dot{I}_s$) prior to exit through the outlet (18), wherein the system of hollow elements further contains an inlet expansion chamber (5) delimited by the front face (3) and an inlet transverse partition (6), a common outlet expansion and mixing chamber (16) delimited by an outlet transverse partition (15) and the rear face (17), wherein the non-shifted noise wave flow path ($\dot{I}_n$) includes a first inner expansion chamber (8) formed between the inlet transverse partition (6) and the outlet transverse partition (15), wherein the first inner expansion chamber (8) includes a first inlet opening (7) formed in the inlet transverse partition (6) and a second inlet opening (19) formed in the outlet transverse partition (15) that connects the first inner expansion chamber to the inlet expansion chamber (5) and the common outlet expansion and mixing chamber (16), respectively, wherein the shifted noise wave flow path ($\dot{I}_z$) includes 4n+2 second inner expansion chambers (12, 14), parallel to the first inner expansion chamber (8) of the non-shifted noise wave flow path ($\dot{I}_n$), and separated by a mid-transverse partition (13) disposed between the inlet and the outlet transverse partitions (6, 15), wherein n is equal to zero or a positive integer, a third inlet opening (7'), formed in the inlet transverse partition (6) to connect the inlet expansion chamber (5) to the second inner expansion chambers (12,14), a fourth inlet opening (7"), formed in the mid-transverse partition (13) to connect the second inner expansion chambers (12, 14)

a fifth inlet opening (19') formed in the outlet transverse partition (15) that connects the second inner expansion chambers (12, 14) to the common outlet expansion and mixing chamber (16), and resonator tubes (11) extending from each of the third and fourth inlet openings (7', 7") in the direction of the inlet gas flow into each of the second inner expansion chambers (12, 14), wherein a ratio of a length of each resonator tube (11) to a length of the corresponding second inner expansion chamber (12, 14) of the shifted noise wave flow path ($\dot{I}_z$) lies in a range of 0.3 to 0.8 and a ratio of a cross-sectional area of each resonator tube (11) to the cross-sectional area of the exhaust gas supply pipe (2) lies in a range of 0,3 to 0.8 and a cross-sectional area of the inlet openings (7, 7', 7") of the transverse partitions (6, 13) is within 10% of the cross-sectional area of the resonator tubes (11) and wherein the length of the first expansion chamber (8) of the non-shifted noise wave flow path ($\dot{I}_n$) is within 10% of the sum of all lengths of the second inner expansion chambers arranged sequentially.

2. The combined exhaust gas noise silencer according to the claim 1, wherein the first inner expansion chamber (8) of the non-shifted flow and the second inner expansion chambers (12, 14) of the shifted flow are separated by means of at least one elongated partition (9), longitudinal to the silencer axis.

3. The combined exhaust gas noise silencer according to the claim 1, wherein the number of sequentially arranged second inner expansion chambers (12, 14) of the shifted flow is two.

4. The combined exhaust gas noise silencer according to claim 1, wherein each of the second inner expansion chambers (12, 14) of the shifted flow is provided with identical resonator tubes (11), provided that the ratio of the length of each tube (11) to the length of the corresponding second inner expansion chamber (12, 14) of the shifted flow is within 0.5±0.1.

5. The combined exhaust gas noise silencer according to claim 1, wherein the ratio of the cross-sectional area of each tube (11) to the cross-sectional area of the inlet exhaust gas supply pipe (2) is 0.5±0.1.

6. The combined exhaust gas noise silencer according to claim 1, wherein the cross-sectional area of the inlet openings (7, 7, 7") within 1% as the size the cross-section area of the resonator tubes (11).

7. The combined exhaust gas noise silencer according to claim 1, wherein the length of the first inner expansion chamber (8) of the non-shifted flow is the same ±within 1% as the sum of the lengths of all sequentially arranged second inner expansion chambers (12, 14) of the shifted flow.

8. The combined exhaust gas noise silencer according to claim 1, wherein the inner cross-section of the resonator tubes (11) have the shape of one of the following: circular, oval, rectangular, trapezoidal, square, diamond, rhomboidal, polygonal, or cascade.

9. The combined exhaust gas noise silencer according to claim 1, wherein the outlet end of the resonator tubes (11) have a cross sectional shape being one of: rounded, convex or concave.

10. The combined exhaust gas noise silencer according to claim 1, wherein the outlet (18) of the rear face of the silencer is a perforated partition with a plurality of openings or piping.

* * * * *